US005359157A

United States Patent [19]

Liu

[11] Patent Number: 5,359,157

[45] Date of Patent: Oct. 25, 1994

[54] CONTACT TYPE INDIRECT CONDUCTION, VIBRATING TYPE MICROPHONE

[75] Inventor: Luis Liu, Kao Hsiung, Taiwan

[73] Assignee: Jen-Cheng Peng, Yung Ho, Taiwan

[21] Appl. No.: 113,475

[22] Filed: Aug. 30, 1993

[51] Int. Cl.[5] ..... H04R 25/00

[52] U.S. Cl. ..... 181/129; 181/158

[58] Field of Search ..... 181/129, 130, 135, 137, 181/158; 381/151, 155, 158, 174, 169; 439/382

[56] References Cited

U.S. PATENT DOCUMENTS

| | | | |
|---|---|---|---|
| 2,238,741 | 4/1941 | Lauffer | 181/129 |
| 4,501,462 | 2/1985 | Fidi | 439/382 |
| 4,742,887 | 5/1988 | Yamagishi | 181/129 |
| 4,981,194 | 1/1991 | Kamon et al. | 181/129 |

*Primary Examiner*—Michael L. Gellner
*Assistant Examiner*—Khanh Dang
*Attorney, Agent, or Firm*—Lowe, Price, LeBlanc & Becker

[57] ABSTRACT

A contact type indirect conduction, vibrating type microphone comprised of a body having a vibration damper on the inside, a fastening device connected to the body for fastening around the neck or the head, the vibration damper having a top recess, a peripheral flange, and a plurality of projecting rods raised from a bottom thereof, a capacitive microphone disposed within the top recess of the vibration damper, a sponge covered on the vibration damper over, and a top cover with a diaphragm covered over the sponge and adhered thereto by a double-sided adhesive tape.

2 Claims, 3 Drawing Sheets

CONTACT TYPE INDIRECT CONDUCTION, VIBRATING TYPE MICROPHONE

BACKGROUND OF THE INVENTION

The present invention relates to microphones, and more particularly to a contact type indirect conduction, vibrating type microphone.

According to the method of the detection of voice frequency, conventional microphones can be gathered into two groups, namely the air vibrating type microphones and the inertial vibrating type microphones. The features of these two types of microphones are outlined hereinafter.

(1) Air Vibrating Type Microphones

The vibrations of air pressure cause the diaphragm of the microphone to change its position synchronously according to the variations of the pressure and the frequency. The energy of the vibrations of the diaphragm is then converted into a variable electric signal. This type of microphones will simultaneously pick up other sound sources, and therefore the communication quality will be affected by the noises received. More particularly, when the microphone is used in a noise area or during the game of a high speed sport such as driving a motorcycle, conveying by a parachute, manipulating a hang glider, etc., loud noises will be simultaneously picked up to interfere with the communication. Sometimes, accidents may happen due to poor communication quality.

(2) Inertial Vibrating Type Microphones

An inertial vibrating type microphone detects the variation of position changes between the shell and the internal "detecting mass". As a sufficient external energy is transmitted to the shell to vibrate the mass of the detecting body, the relative position between the shell and the detecting body is relatively changed, and the variations of the changes of the relative position between the shell and the detecting body are then converted into a variable electric signal. This type of microphones eliminate outside noises (noises in the atmosphere). When in use, the microphone is directly attached to the muscles around the throat to detect the vibrations of the muscles of the throat while speaking. As the muscles are mainly composed of water, the vibrating energy of the throat can be directly transmitted to the microphone. Because the vibrating energy of the air is very small and can not vibrate the shell of an inertial vibrating type microphone, outside noises will not be picked up during the detection of the microphone. Therefore, an inertial vibrating type microphone is suitable for use in noise conditions. However, this type of microphones still can not effectively eliminate noises from being picked up during its detection. If the fastening device, shell, or connecting line of the microphone is rubbed against the clothes or another other objects, noises will be produced to interfere the detection of the sound to be detected, and therefore the communication quality will be affected.

SUMMARY OF THE INVENTION

The present invention has been accomplished under the aforesaid circumstances. It is therefore the principal object of the present invention to provide a contact type indirect conduction, vibrating type microphone which effectively eliminates outside noises and greatly improve the quality of communication. It is another object of the present invention to provide a contact type indirect conduction, vibrating type microphone which is durable in use. According to the preferred embodiment of the present invention, the contact type indirect conduction, vibrating type microphone is comprised of a body having a vibration damper on the inside, a fastening device connected to the body for fastening around the neck or the head, the vibration damper having a top recess, a peripheral flange, and a plurality of projecting rods raised from a bottom thereof, a capacitive microphone disposed within the top recess of the vibration damper, a sponge covered on the vibration damper over, and a top cover with a diaphragm covered over the sponge and adhered thereto by a double-sided adhesive tape. The fastening device can be conveniently fastened around the neck or the face, permitting the body to be closely attached to the muscles of the throat or the cheeks to effectively detect the vibrations of the muscles. The microphone can also be used as a membrane-covered chestpiece to detect sounds of the abdomen. It can also be used to detect vibrating waves of the wall or any solid object.

DETAILED DESCRIPTION OF THE PREFERRED EMBODIMENT

Figure 1:
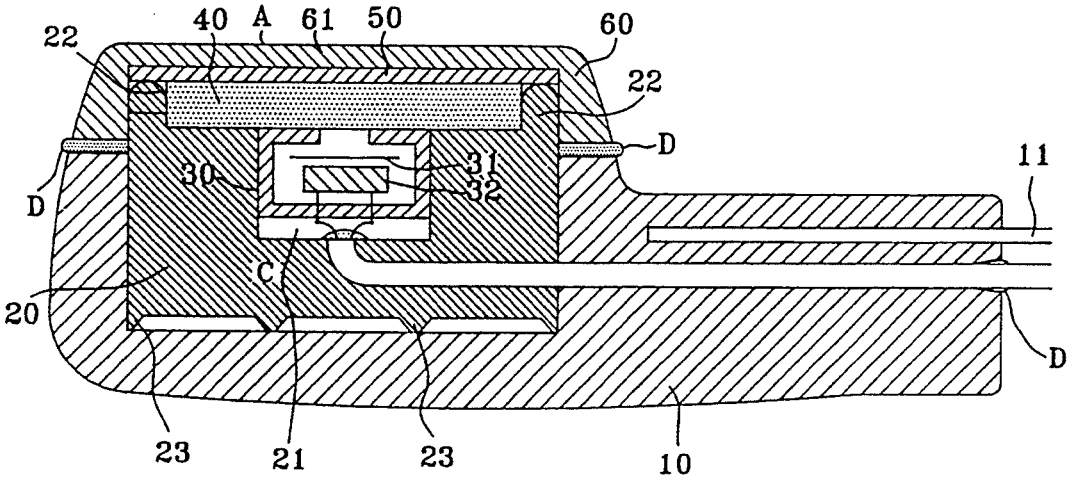
FIG. 1 is a sectional view showing the structure of the preferred embodiment of the present invention.

Referring to FIG. 1, a fastening device 11 is connected to the body 10 of the microphone for fastening to the user at a suitable location. A vibration damper 20 which may be made of silicon rubber, natural rubber, or any suitable material, is fastened inside the body 10. The vibration damper 20 comprises a top recess 21 in the center, a flange 22 on an outer side, a plurality of projecting rods 23 raised from the bottom thereof. A capacitive microphone 30 is received within the top recess 21 of the vibration damper 20 and covered in proper order by a sponge 40, a double-sided adhesive tape 50, and a top cover 60. The sponge 40 is fastened to the top cover 60 by the double-sided adhesive tape 50. The cover face of the top cover 60 is a diaphragm 61. The thickness of the diaphragm 61 is thinner than all walls of the top cover 60 and the body 10.

Figure 2:
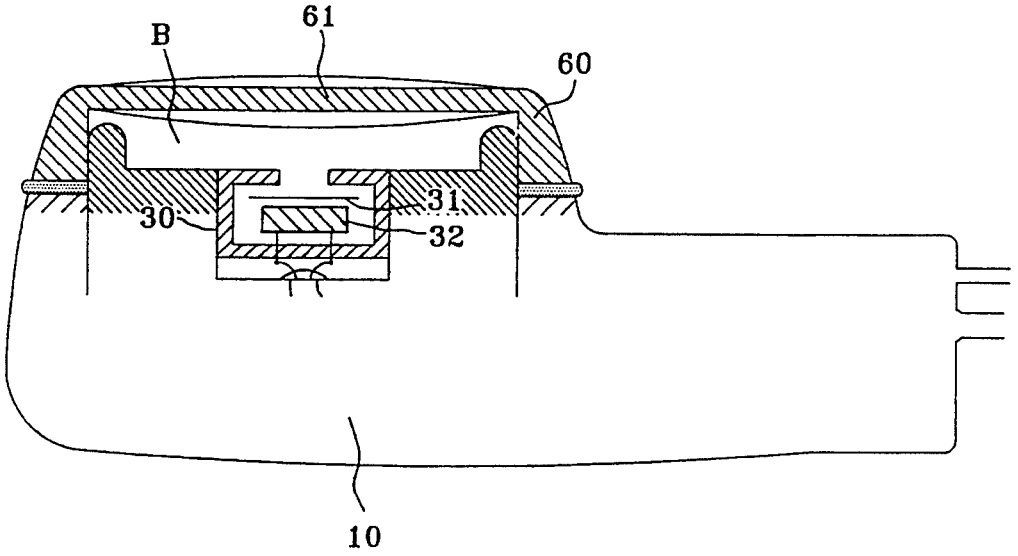
FIG. 2 is a schematic drawing showing the detecting structure of the preferred embodiment of the present invention.

The voice frequency detection of the present invention is outlined hereinafter with reference to FIG. 2. The material of the diaphragm 61 (namely, the top cover 60) can be a rubber or any suitable elastic material, which will not be easily vibrated by the energy of the vibration of air produced in the working area, but can be easily vibrated by the liquid vibration energy produced by the vocal cords. The surface of the diaphragm 61 is a detecting surface A. As the detecting surface A is induced by a sufficient liquid vibrating energy, it is immediately caused to change the position (see the dotted line). As the position of the diaphragm 61 is changed, the air pressure of the "pressure variable space" (see B in FIG. 2) is relatively changed, and therefore the diaphragm 31 of the capacitive microphone 30 is vibrated. As the diaphragm 31 of the capacitive microphone 30 is vibrated, the variable energy converter 32 of the capacitive microphone 30 converts the variable energy into a variable electric signal. The electric signal changes according to the amplitude of the vibration of the diaphragm 61. The vibration damper 20 is to protect the non-detecting surface of the body 10 from being vibrated so that the air pressure in the pressure variable space is retained stably.

The microphone is operated through an indirect induction action because liquid vibrating energy must be converted into air vibrating energy so that it can be further converted into a variable electric signal.

In the detection of the vibration of the muscles around the vocal cords (including the vibration of the face, throat, lug, and head), a liquid vibration detector is superior than an inertial vibration detector, because: (1) sound source is a "liquid vibration"; (2) the diaphragm 61 has only one detecting surface A on one side thereof, and it prohibits entrance of the vibrating energy other than the sound source; it is not an inertial vibration detector, and it eliminates the detection of the vibrating energy produced by the clothes, connecting line, or other objects rubbing against the fastening device or shell of the microphone. It will be explained how the microphone prohibits entrance of "inertial vibrating energy".

Referring to FIG. 1 again, the embodiment shown in the drawing is suitable for a mass production. However, variations may be made without departing from the spirit and scope of the invention. The diaphragm 61 is made from an elastic solid material in thickness suitable for being vibrated by the throat vibrating energy to produce a pressure variation within the pressure variable space B for detection by the capacitive microphone 30, and for blocking up the transmission of air energy. The diaphragm 61 can also be made of rubber, or in the form of a flat liquid cell suitable for conducting liquid energy and prohibiting air vibrating energy from entering the pressure variable space B.

The sponge 40 is used: (1) to eliminate resonance and echo in the pressure variable space B; (2) to reduce the volume of air in the pressure variable space B so as to let most energy be transmitted to the capacitive microphone 30 without being consumed during the process of the collision of air molecules; (3) to support the diaphragm 61 flexibly so that the diaphragm 61 can effectively prohibit air vibrating energy from passing through and eliminate the resonance during its vibration. Because the sponge 40 is deformable, liquid vibrating energy can easily deform the sponge 40, causing the pressure vibration space B to make changes according to the variation of the amplitude of the vibration, and therefore the capacitive microphone 30 can effectively detect the variation of the energy.

By means of the elastic, flexible, and airtight properties of the flange 22 of the vibration damper 20, the bonding of the double-sided adhesive tape 50, and the sealing of the sealing rubber C beneath the capacitive microphone 30, the pressure within the pressure variable space B is retained stably.

The vibration damper 20 is made of an elastic, airtight, rubber material, and used: (1) to protect the pressure variable space B against the interference of outside pressure energy; and (2) to eliminate or reduce inertial energy from being transmitted from the body 10 and the top cover 60 to the capacitive microphone 30. Basically, the capacitive microphone 30 detects energy of the vibration of air being acted on the diaphragm 31. Because the diaphragm 31 has a mass (which is much smaller than that of an inertial vibrating type microphone), part of the vibrating energy of the shell can be absorbed by means of the effect of the vibration damper 20 and its projecting rods 23, and therefore less inertial vibration is acted on the diaphragm 31 of the capacitive microphone 30.

The body 10 and the top cover 60 form the shell of the present invention. The shell protects the microphone against damage. It can be made of a rigid or flexible material that is water-proof, weather-proof, chemical-proof, and of high impact strength. The connection between the body 10 and the top cover 60 is sealed by a water seal D to protect the internal structure against moisture. The fastening device 11 is directly connected to the body 10. The body 10 and the top cover 60 may be directly molded together, and then the body 10 and the top cover 60 and the vibration damper 20 may be bounded together by means of the application of an inertial vibration prohibiting and air pressure isolating material. The diaphragm 61 may be separately made and then fastened to the top cover 60.

Figure 3:
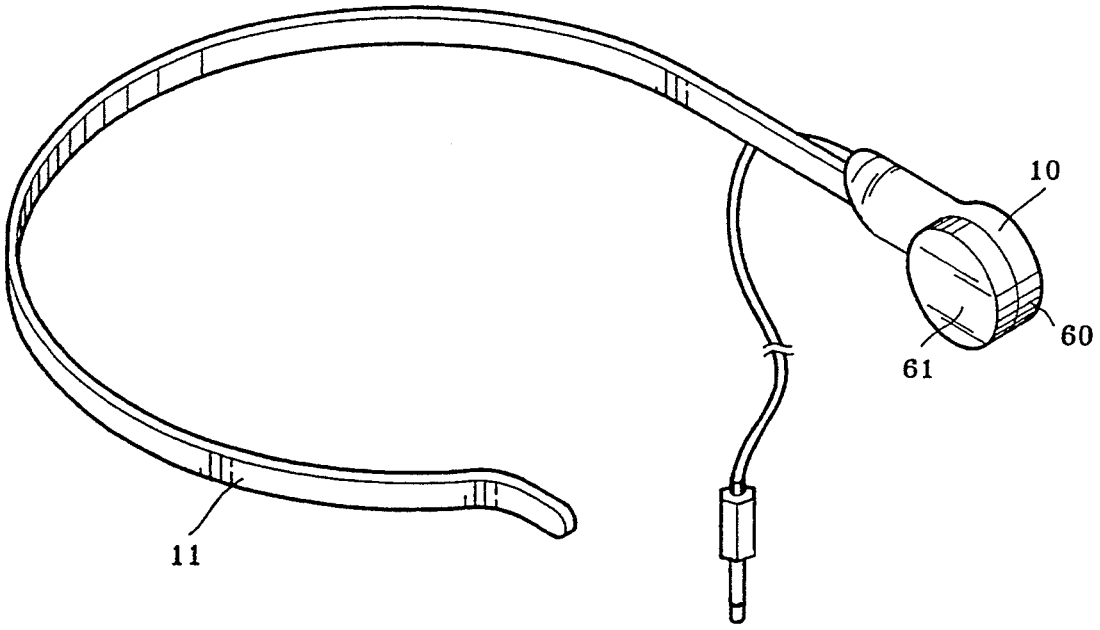
FIG. 3 is an elevational view of the preferred embodiment of the present invention.

The fastening device 11 is made of a flexible material suitable for fastening around the neck or the head. In the embodiment shown in FIGS. 3 and 4, the fastening device 11 is made in the form of a C-shaped clamp suitable for fastening around the neck.

Figure 4:
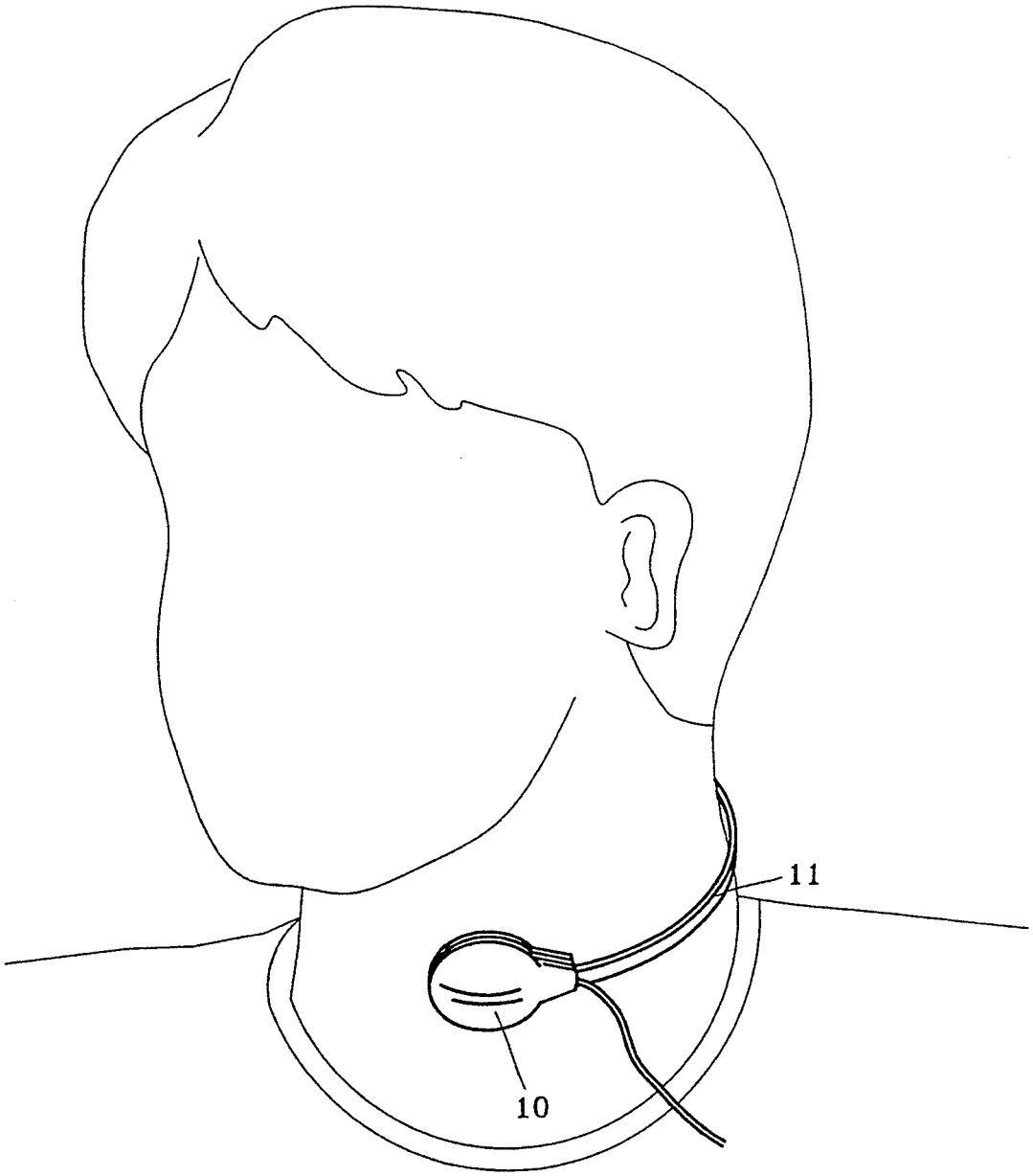
FIG. 4 is an applied view showing the microphone fastened around the neck.

When in use, the fastening device 11 may be fastened around the neck or the head with the diaphragm 61 of the top cover 60 attached to the throat, the face, or the cheek. It can be used as a membrane-covered chestpiece to detect sounds of the abdomen. It can also be used to detect vibrating waves of the wall or any solid object. As illustrated in FIG. 4, the fastening device 11 is fastened around the neck with the detecting surface A closely attached to the muscles of the throat. The closer the detecting surface A is attached to the throat, the bigger the amount of vibrations detected. If the detecting surface A is tightly attached to the throat, the surface pressure on the detecting surface A is relatively increased. However, the increasing of the surface pressure on the detecting surface A does not change the liquid vibration energy being detected. As the shell (the body 10 and the top cover 60) is tightly pressed against the detecting surface A, a bigger difference of energy potential between the detecting surface A and the internal structure of the shell is resulted for detection.

As indicated, the present invention provides a waterproof, dust-proof, shock-proof, and durable microphone which eliminates the drawbacks of conventional microphones. However, while only one embodiment of the present invention has been shown and described, it will be understood that various modifications and changes could be made thereunto without departing from the spirit and scope of the invention.

What is claimed is:

1. A contact type indirect conduction, vibrating type microphone comprising a body, a fastening device connected to said body for fastening, said body comprising a vibration damper disposed inside, said vibration damper comprising a top and a bottom, said top having a top recess in the center, a flange extending from said top, and a plurality of projecting rods raised from a bottom thereof, a capacitive microphone disposed within said top recess, a sponge covering said vibration damper and disposed over said capacitive microphone, and a top cover disposed over said sponge and adhered thereto by a double-sided adhesive tape, said top cover comprising a cover face formed of a diaphragm having a thickness thinner than the walls of said top cover and said body.

2. The contact type indirect conduction, vibrating type microphone of claim 1 wherein said body, said top cover, and said vibration damper are integrally molded together, and said diaphragm of said cover face is separately made and then fastened to said top cover.

* * * * *